US007353761B2

(12) United States Patent
Janouschek

(10) Patent No.: US 7,353,761 B2
(45) Date of Patent: Apr. 8, 2008

(54) SEWING MACHINE

(76) Inventor: Georg Janouschek, Riethaldenstrasse 2, Steckborn (CH) CH-8266

( * ) Notice: Subject to any disclaimer, the term of this patent is extended or adjusted under 35 U.S.C. 154(b) by 279 days.

(21) Appl. No.: 10/554,646

(22) PCT Filed: May 3, 2004

(86) PCT No.: PCT/CH2004/000267

§ 371 (c)(1),
(2), (4) Date: Oct. 27, 2005

(87) PCT Pub. No.: WO2004/099481

PCT Pub. Date: Nov. 18, 2004

(65) Prior Publication Data

US 2006/0278144 A1 Dec. 14, 2006

(30) Foreign Application Priority Data

May 5, 2003 (CH) ..... 0782/03

(51) Int. Cl.
*D05B 1/08* (2006.01)
*D05B 69/02* (2006.01)

(52) U.S. Cl. ..... 112/81; 112/221; 112/163

(58) Field of Classification Search ..... 112/81, 112/437, 160, 197, 98, 116, 170, 173, 163, 112/221

See application file for complete search history.

(56) References Cited

U.S. PATENT DOCUMENTS

| | | | | |
|---|---|---|---|---|
| 1,715,079 | A * | 5/1929 | Eames et al. | 112/81 |
| 1,920,784 | A * | 8/1933 | De Voe | 112/437 |
| 1,958,207 | A * | 5/1934 | Albrecht et al. | 112/160 |
| 2,093,558 | A * | 9/1937 | Hirsch | 112/81 |
| 2,491,457 | A * | 12/1949 | Sigoda | 112/98 |
| 4,366,763 | A | 1/1983 | Teetz et al. | |
| 4,543,897 | A | 10/1985 | Heinzle | |
| 6,973,887 | B2 * | 12/2005 | Rattay | 112/197 |

FOREIGN PATENT DOCUMENTS

| | | |
|---|---|---|
| DE | 100 814 | 3/1898 |
| DE | 109 522 | 1/1899 |

* cited by examiner

*Primary Examiner*—Ismael Izaguirre
(74) *Attorney, Agent, or Firm*—Volpe and Koenig, P.C.

(57) ABSTRACT

A sewing machine having two needles (8, 9) that are at an angle (alpha) to the vertical axis of a piercer (C) is provided. After the piercer has pierced the item to be sewn with a tip thereof, the needles pierce through vertical slits (27) in the piercer (C). The two needles are driven in a direction of the respective axis thereof, i.e., in a direction of the axes ($V_1$, $V_2$).

8 Claims, 4 Drawing Sheets

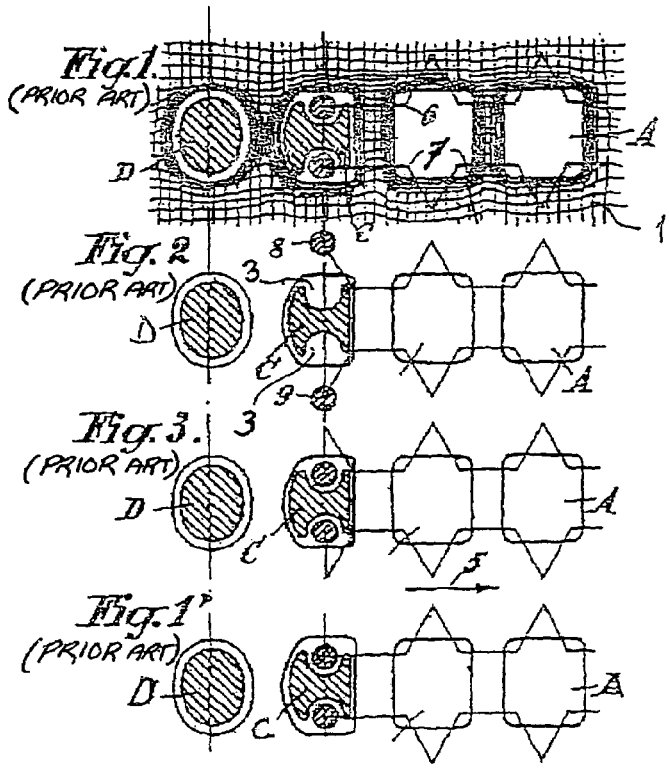
Fig.1.
(PRIOR ART)
Fig. 2
(PRIOR ART)
Fig. 3.
(PRIOR ART)
Fig. 1'
(PRIOR ART)
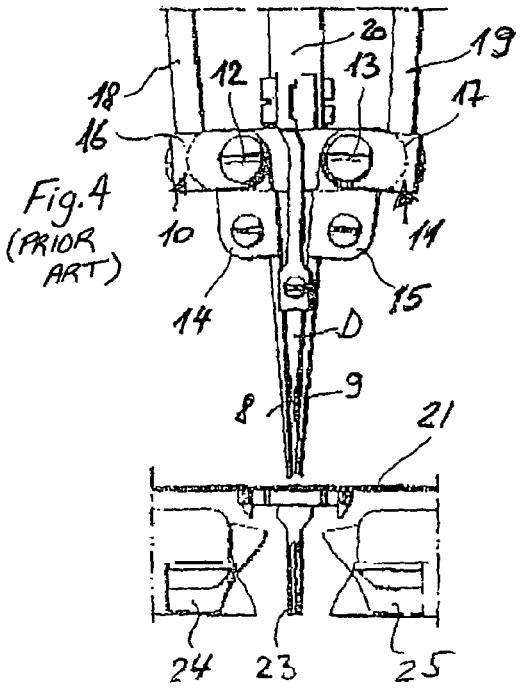
Fig. 4
(PRIOR ART)
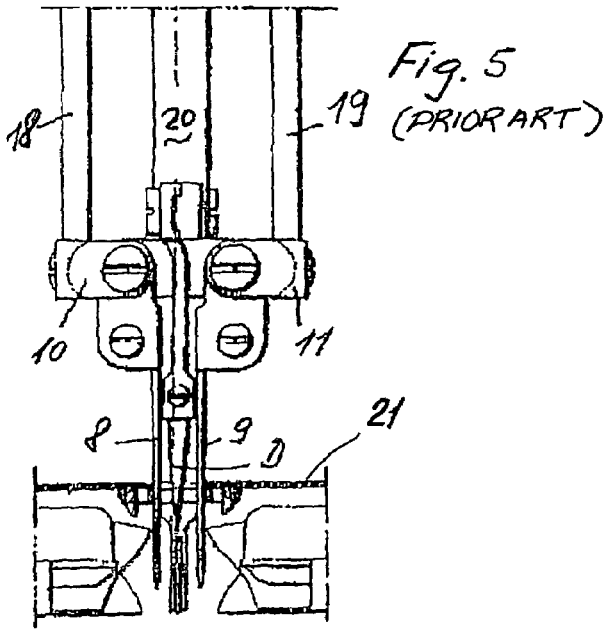
Fig. 5
(PRIOR ART)

SEWING MACHINE

BACKGROUND

The subject matter of the invention is a sewing machine and also a piercer for a sewing machine.

Hemstitching machines and two-needle sewing machines have been known for over one hundred years and still operate using the same principle today. According to this principle, two needles, which are each associated with one hook, create two zigzag stitching sections that are parallel to each other. In order to separate the two stitches from each other, the woven threads are pushed somewhat apart with an auxiliary piercer and an opening or a hole is formed in the fabric. In order to be able to loop the woven threads forced apart with the needles at the edges of the holes, deep grooves at the side running in the axial direction are embedded in the piercer. Due to the tension of the woven threads, there is still free passage for the needles in the grooves for a piercer that has already cut into the fabric. In order to be able to lead the needles through these two opposing passages, the latter are mounted so that they can rotate on the lower end of the common needle-and-auxiliary piercer bar oscillating vertical to the needle plate and are moved in an oscillating manner. That is, a first stitch is realized with inwards pivoted needles, so that their tips are guided into the side grooves of the piercer through the opening created in the free space of the grooves in the fabric reaching downwards to the hooks. During the piercing, the needles contact the grooves with such a strong force that they exhibit bending. The subsequent stitch is then realized with needles that have been pivoted back, i.e., that are not bent and that penetrate essentially vertically into the fabric. For the next stitch, the needles are pivoted inwards again and are bent when they cut into the fabric and contact the grooves of the piercer. They are also bent somewhat to the side by the hooks, so that the tip of the hook can grip the needle thread loop.

This method, which has been used unchanged for a century, has the disadvantage that for every second stitch, lateral forces act on the needle and bend the needle. In addition, it is not guaranteed that all of the woven threads will be pressed outwards during the inner stitch, i.e., the stitch, for which the needles are guided bent into the grooves of the piercer. Often there are still individual woven threads within the opening, which degrades the visual image of the hemstitch, because they cross through the formed hole. Another disadvantage consists in the fact that the tips of the needles lie very close to each other for complete engagement in the fabric and consequently the tips of the two hooks under the needle plate must also lie very close to each other. Due to the close arrangement of the two hooks, the piercer cannot penetrate very deeply into the fabric or its tip must have a large tapering angle in order to form sufficiently large holes. This has the consequence that when the woven threads are spread by the quick penetration of the "blunt" tip of the piercer, the woven threads can be ripped. Such a hemstitching machine is disclosed in U.S. Pat. No. 2,093,558.

SUMMARY

The object of the present invention is the creation of a sewing machine and a piercer, which overcomes the disadvantages of the known machines and which enables the problem-free production of hemstitches both on loosely woven and also tightly woven fabric.

This object is achieved by a sewing machine and a piercer for a sewing machine according to the invention Advantageous configurations of the sewing machine are defined in the description and claims that follow.

The sewing machine according to the invention is successful in generating hemstitches with larger holes and greater spacing of the holes. Furthermore, the needles are not bent, because during piercing, the needles are neither pressed to the side nor make a translating movement, but instead always oscillate exactly along the needle axis. Through the needles oscillating at an acute angle to the axis of the piercer, the needle tips are farther apart from each other by several times than before when they have cut into the fabric completely and the two hooks can be arranged at a greater mutual distance and also at the exact optimum position in terms of sewing. Hooks with horizontal rotational axes can be used, so that the changing of the bobbin is possible without lifting the fabric from the needle plate. The hooks lying farther apart enable the use of a piercer and an auxiliary piercer with significantly smaller taper, i.e., with a significantly longer tip, so that the woven threads are pushed apart less quickly during stitching and therefore breaks in the thread can be prevented. Because the two needles lying in a V shape relative to each other pass through the opening in the fabric formed by the piercer, it is prevented that individual woven threads are not looped by the sewing threads. The needles oscillating continuously in the direction of the needle axis are subjected to no bending forces and therefore breakage of the needle due to material fatigue can be ruled out. Furthermore, there is very good access to the needle eyes for inserting the needle thread.

The piercer can be mounted on a household sewing machine and enables hemstitching even in the private sector.

BRIEF DESCRIPTION OF THE DRAWINGS

The invention is explained in more detail with reference to an illustrated embodiment. Shown are:

FIG. 1 a top view of fabric and horizontal section through the two needles, guided into the grooves of the piercer (fabric indicated), FIG. 2 a horizontal section above the fabric in FIG. 1, needle pivoted outwards, FIG. 3 a horizontal section above the fabric during the third stitch (needles running in grooves of the piercer in FIG. 1', as in FIG. 1 the beginning of the following hemstitch hole), FIG. 4 a vertical section through a hemstitching machine according to the state of the art in the region of the needles and hooks with inwards pivoted needles, FIG. 5 a vertical section through a hemstitching machine according to the state of the art in the region of the needles and hooks with outwards pivoted needles, FIG. 6 a side view of the auxiliary piercer and a piercer with two vertical slots, FIG. 7 a side view of the two piercers in another configuration of the invention, FIG. 8 a top view of the needle plate with the small advancing belts, FIG. 9 a vertical section through the hemstitching machine according to the invention in the region of the needles and hooks (stitching point on the outside), and FIG. 10 a vertical section through the hemstitching machine according to the invention in the region of the needles and hooks (stitching point on the inside), FIG. 11 an enlarged view of the needles and the recess in the piercer according to FIG. 9 and stitching point, FIG. 12 an enlarged view of the needles and the recess in the piercer according to FIG. 10 and stitching point in the stitching pattern, FIG. 13 a vertical section through the vertical needle of a household sewing machine and a piercer lying at an acute angle to the needle for a needle that has already cut into the fabric, FIG. 14 a vertical section through the vertical needle of a household sewing machine and a piercer lying at an acute angle to the needle for a raised needle, FIG. 15 a view of a piercer with side grooves, FIG. 16 a side view of the piercer according to FIG. 15 with lowered needle (lying in the groove), FIG. 17 a schematic side view of a hemstitching machine according to the invention, FIG. 18 a schematic side view of a household sewing machine with a piercer according to the invention.

DETAILED DESCRIPTION OF THE PREFERRED EMBODIMENTS

Figure 6:
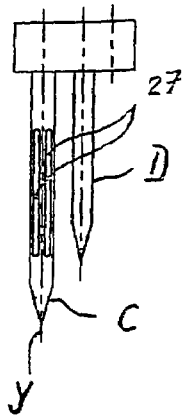

For better understanding of the invention and the differences with the state of the art, the formation of a hemstitch with a conventional hemstitching machine according to U.S. Pat. No. 2,093,558 is illustrated and explained in FIGS. 1 to 5. In FIG. 1, the fabric 1 can be seen, in which two hemstitch openings or holes A have already been created. The piercer D, whose cross section can be, for example, oval, is pressed into the fabric 1. The auxiliary piercer C lying behind at a spacing is also pressed into the fabric 1. In the auxiliary piercer C, two axial grooves 3 can be seen on the side (see, in particular, FIG. 2). In FIG. 1 the two needles 8 and 9 already lie in these grooves. Due to the spreading movement of the woven threads through the double piercing, first the auxiliary piercer D and then the piercer C, the woven threads are forced to the side and the needles 8 and 9 can cut into the recess A. In the second sewing step according to FIG. 2, the needles 8 and 9 are pivoted outwards, in sewing terminology swung outwards, and pierce directly into the fabric 1 outside of the recess A. For each cut-in of the two needles 8 and 9, the two needle threads 6 and 7 are looped with the not-shown bobbin thread and when the needles 8, 9 are pulled out of the fabric 1, the stitches are pushed together according to the applied thread stress and form zigzag seams along the recess A. FIG. 3 shows the third stitch, for which the two needles 8 and 9 are guided again into the channels of the auxiliary piercer C formed by the grooves 3. FIG. 1' represents the beginning of the creation of a new opening A, after the fabric 1 has been advanced with the feed dog by a step in the direction of the arrow 5.

The oscillation of the two needles 8 and 9 is shown in more detail in FIGS. 4 and 5. The two needles 8 and 9 are hinged so that they can pivot on two-armed levers 10 and 11 about pivot axes 12, 13. The two needles 8 and 9 are mounted on the first lever arms 14 and 15; the second lever arms 16 and 17 are connected to the driving bars 18 and 19. The two two-armed levers 10 and 11 are hinged on the front end of an auxiliary piercer bar 20 that can move up and down in the vertical direction. In addition to the two needles 8, 9, the two piercers C, D, namely the auxiliary piercer D and the piercer C, are also mounted on the piercer bar 20. The piercers C, D and the two needles 8, 9 are moved up and down in sequence together with the piercer bar 20 vertical to the needle plate 21. Here, the diagonal needles 8, 9 experience bending outward towards the piercer.

Underneath the needle plate 21, the feed dog 23 and the two hooks 24, 25 can be seen.

In FIG. 4, the piercer bar 20 with the needles 8 and 9, and also the piercers D and C, are shown in the highest position, in which the fabric 1 can be pushed under the needles 8 and 9 or the piercers D and C. The two needles 8 and 9 are pivoted inwards, i.e., their tips are close to each other and they also lie in the side grooves 3 of the second piercer C according to FIG. 1 (not visible in FIG. 4). In this opposing position, i.e., needles 8 and 9 set at an angle, they are guided downwards together with the piercers D and C by the needle bar 20 through the fabric 1 and also through the needle plate 21. Here, the two needles 8 and 9 execute a translating movement, i.e., their tips cut into the fabric close to each other and for further downwards movement (not shown), the two needles force the fabric 1 outwards due to their inclined position. Shortly before the stroke of the piercer bar 20 is reversed, the two needle thread loops are gripped by the tips of the two hooks 24 and 25 and looped with the bobbin thread.

During the stitching according to FIG. 2, the two needles 8 and 9 are swung outwards (see also FIG. 5) and now lie vertical to the needle plate 21. Here, they cut through the fabric 1 and form the first zigzag stitch. From FIG. 5 it can be seen that the two hook tips must be so far apart that the two needles 8 and 9 can pass by. This means that the thread loop transfer is never optimal in terms of sewing, neither in the case of needles swung together nor in the case of needles 8, 9 spaced apart from each other.

Figure 9:
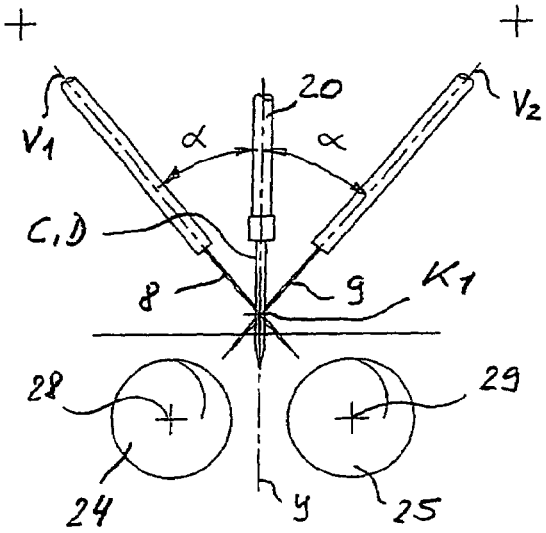
Figure 10:
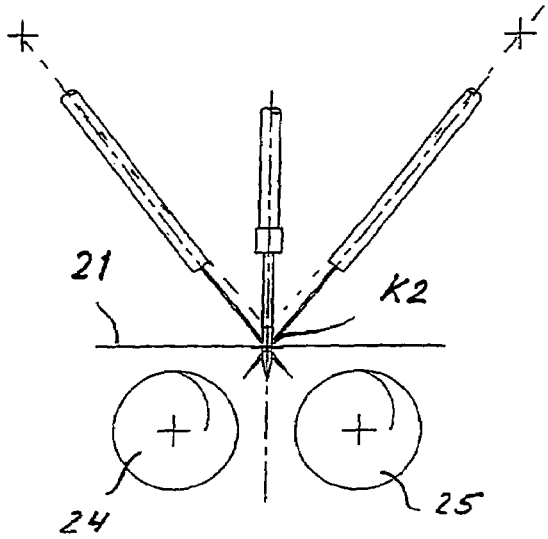
Figure 17:
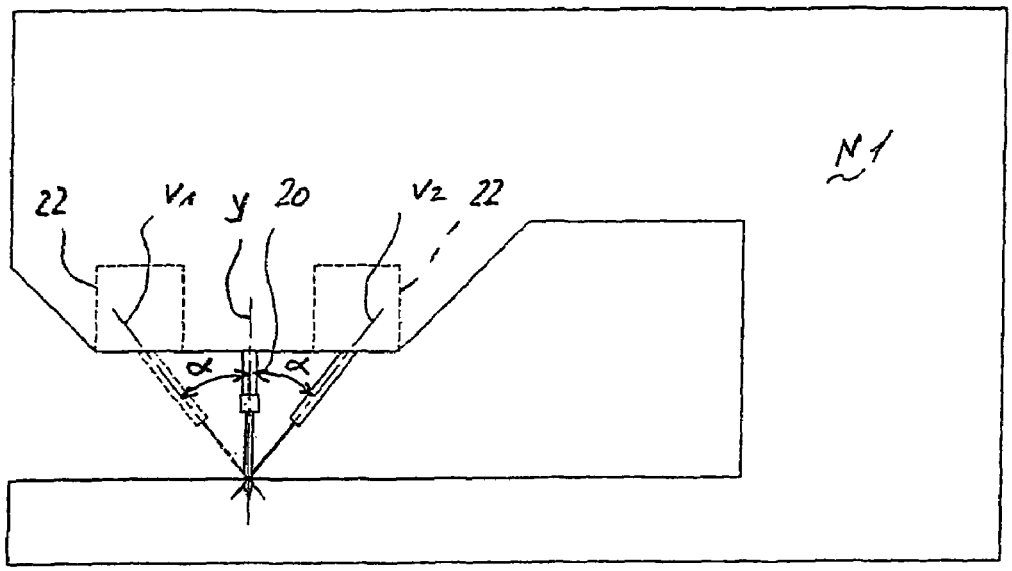

In the schematic representations according to FIGS. 9 and 10, which shows the geometric arrangement of the two needles 8 and 9 in the configuration of the sewing machine N1 according to the invention, it can be seen according to FIG. 17 that the needle axes $V_1$ and $V_2$ lie at a preferably acute angle alpha to the axis of motion Y of the piercer bar 20. The piercer bar axis Y lies vertical to the surface of the needle plate 21. The movement of the two needles 8, 9 is driven in the two needle axes $V_1$ and $V_2$ with a drive 22 that is independent from, but in sync with, the drive of the piercer bar 20.

Figure 15:
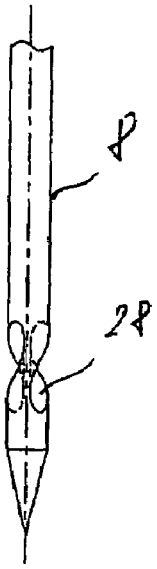
Figure 16:
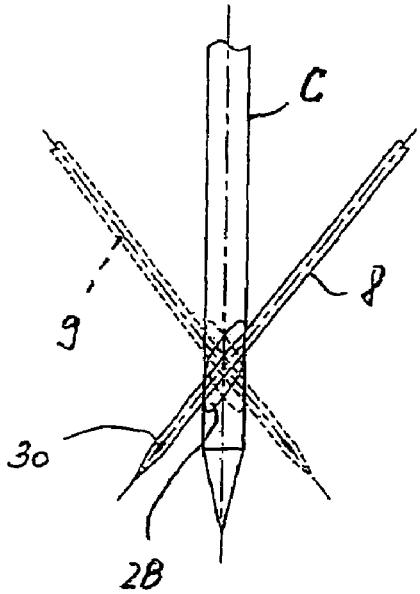

During the stitching of the needles 8, 9, no translating movement takes place. The position of the stitch through the fabric 1 or the fabric plane into the holes is not changed and no lateral forces act on the needles 8, 9 and the woven threads of the fabric 1 during the stitching. In order to enable this crosswise advancing movement of the needles 8, 9, the two needle axes $V_1$ and $V_2$ are offset in the sewing direction 5 by at least one needle diameter, i.e., the needles 8, 9 cross each other (cf. FIG. 11). The crossing point $K_1$ of the two needles 8, 9 lies inside the piercer C. For this purpose, there are two slots 27 running parallel to the longitudinal axis (Y) in the piercer C (cf. FIG. 6). One of the two needles 8, 9 passes through each of these slots 27 after the piercer C has cut into the fabric 1 forming the opening A and after the woven thread of the fabric 1 has been carefully pressed apart. Alternatively, a single recess for both needles 8, 9 can also be provided. In another configuration of the piercer C, grooves 28 can be formed extending diagonally on the piercer. These grooves form the passage for the needles 8, 9 within the piercer cross section (cf. FIGS. 15/16). The two V-shaped vibrating needles 8, 9 lie at an angle of preferably 60° from each other. This interlaced position has the effect that for needles 8, 9 that have been pushed in completely, their tips with the needle threads 6, 7 guided in the corresponding eye 30 do not lie close to each other as in the state of the art, but instead at a significantly greater spacing. This allows the two hooks 24, 25 to rotate vertically, i.e., their rotational axes 28, 29 lie horizontally. This hook arrangement further enables the piercer C to be formed significantly longer and therefore the taper of its tip 30 is reduced significantly and thus the spreading of the woven threads during the cutting in is more gentle, because it is performed more slowly and thus breaks in the thread can be prevented. In addition, the hooks 24, 25 rotating vertically enable the bobbins housed therein to be replaced without lifting the fabric 1 from the needle plate 21. Furthermore, such vertically lying hooks 24, 25 can be arranged behind the needles 8, 9 viewed in the sewing direction 5 and thus a better stitching pattern can be obtained in terms of sewing. The two hooks 24, 25 preferably formed as concentric hooks can be driven in the same direction or in opposite directions.

Figure 11:
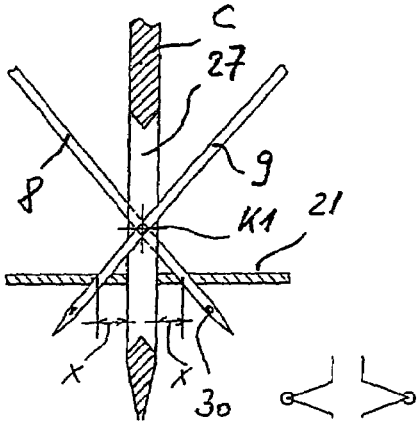
Figure 12:
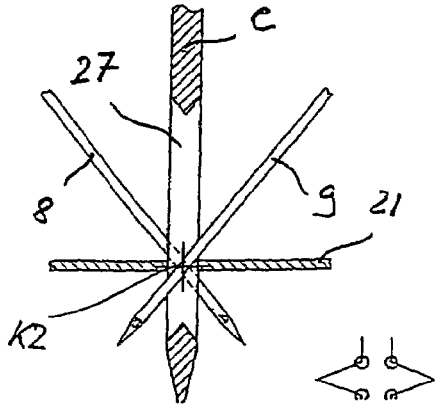

In FIG. 11, the crossing point $K_1$ of the two needles 8, 9 lies above the fabric 1 on the needle plate 21. In this position, the tips of the needle 8, 9 meet at a lateral spacing X to the piercer C on the fabric 1 and penetrate this fabric at an angle alpha. Thus, they form the outer stitching of the zigzag seam formed around the hole A. By a pivot or parallel shift of the needle axes $V_1$, $V_2$, as shown in FIGS. 10 and 12, the crossing point $K_2$ of the needles 8, 9 is shifted downwards into the plane of the needle plate 21 or the fabric 1, which lies on the needle plate 21 (fabric 1 not shown in FIGS. 9 and 10). There, the two needle tips cut into the fabric plane in sequence within the piercer C, i.e., in the opening (free from woven thread) formed by the piercer C. If the piercer C has two grooves 30, which are open on the periphery, which lie diagonal to the piercer axis, and which are formed on the sides, the stitching formation occurs in an analogous manner.

Figure 7:
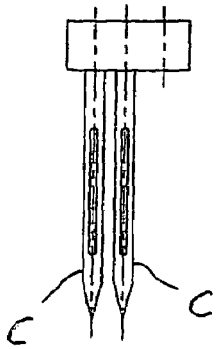

As an alternative to the piercer C shown in FIG. 6 with two vertical slots 27, as it is used in FIGS. 9 and 10, two piercers C each with one slot can be provided, and the two needles 8, 9, obviously spaced apart at a greater distance accordingly, are guided through the piercers C. In this method, the recesses A were not provided in sync on both sides with zigzag seams, but instead offset by an opening A (cf. FIG. 7). This also means that a hemstitch can also be created with only one needle if only one side is to be provided with stitching on the formed openings A.

The crossing point K of the needles 8, 9 can be shifted downwards, as already mentioned, by changing the two angles alpha to the vertical axis Y or by a parallel shift of the needle axes $V_1$ and $V_2$, respectively, outwards. However, the driving direction of the needles 8, 9 is always maintained in the axis direction $V_1$ and $V_2$, respectively. That is, there is no translating movement of the needles 8, 9 as in the previous method according to FIG. 4. Therefore, displacement of the woven threads during the advance of the needles 8, 9 and lateral forces on the needle 8 can be prevented.

Figure 8:
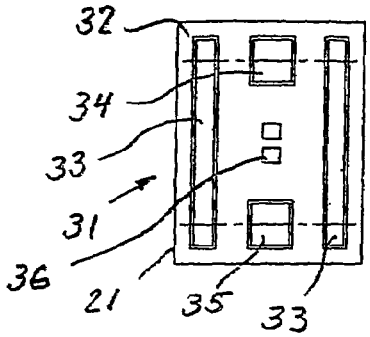

In a preferred configuration of the invention, instead of a conventional feed dog 23, which performs a translating movement on the needle plate 21, there is a double feed dog 31 according to FIG. 8. This comprises two advancing belts 33, which project slightly over the surface 32 of the needle plate 21 or which are guided via this plate. Two clamping and advancing rollers 34, 35 are preferably arranged between the two advancing belts 33, which are driven in steps and with a free-running hub. These advancing rollers can be driven in sync and can be provided with a free-running hub. Above one advancing roller 34, mounted on the presser bar, which has been left out of the drawings for reasons of better clarity, there is a second roller, with which the fabric 1 can be held tight. Through this feed dog 31 according to the invention, the fabric is held tight not only at the sides of the stitching hole 36, but also in front of and behind this hole as if in an embroidery frame. Consequently, the fabric cannot slide uncontrollably either during the stitch formation or during the advancing. The two advancing belts 33 and also at least one of the two advancing rollers 34, 35 are driven typically for every third stitch, i.e., after the completion of a hemstitch opening A. The advance corresponds to the distance of the two axes of the piercers C, D and equals approximately 4 mm. Such a large hole spacing cannot be realized with known machines.

Figure 13:
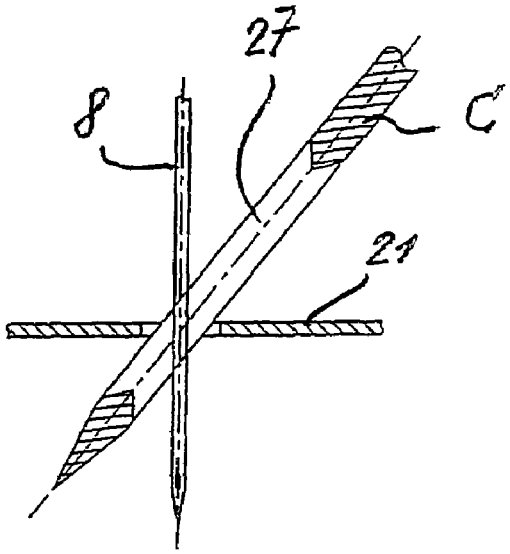
Figure 14:
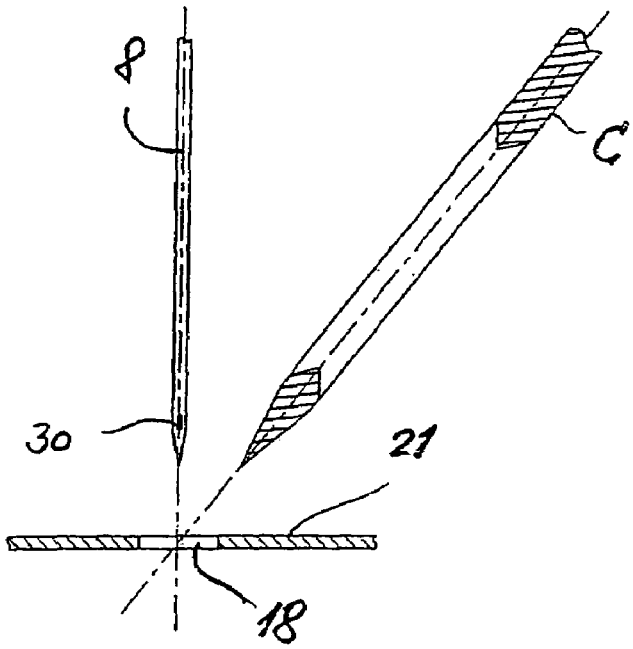
Figure 18:
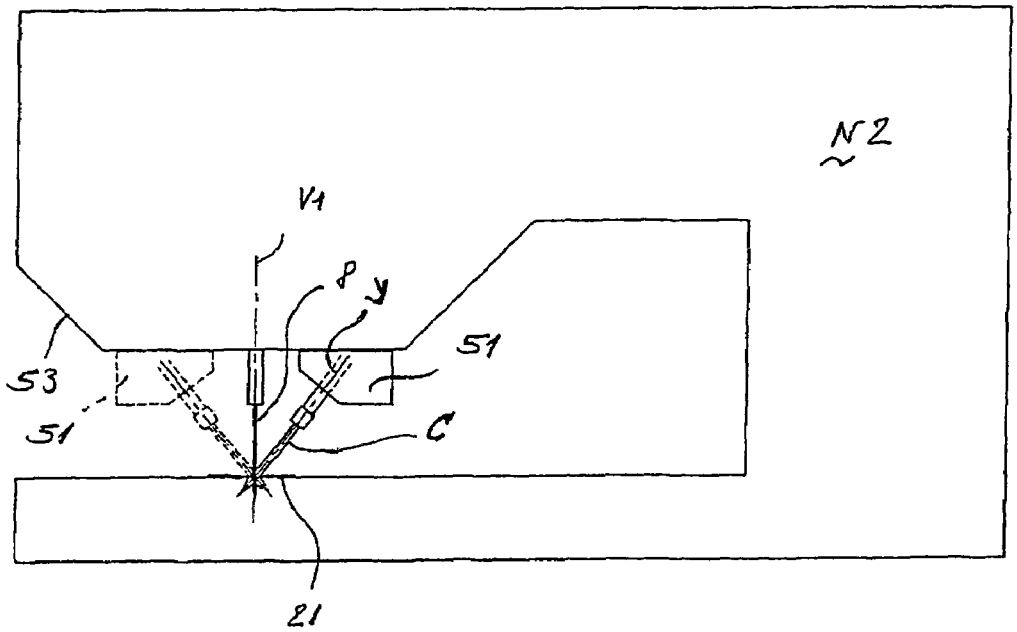

In the FIGS. 13, 14, and also 18, it is shown how the creation of a hemstitch according to the invention with a piercer C, in which there is a passage opening 27 for at least one needle 8, can also be used in a household sewing machine N2. Because the needle 8 is installed rigidly in the household sewing machine according to FIG. 18 and cuts into the fabric vertically, the one or more piercers C are arranged at an acute angle to the needle axis $V_1$. Because there is no driving device for a piercer C in a household sewing machine and also because there is not enough room for such a device in the region at the side of the needle bar, according to the invention the piercer drive is housed in a separate housing 51 that can be attached to the sewing machine N2. The housing 51 is mounted detachably in a suitable way on the bottom, rear, or front side of the upper arm 53 of the sewing machine. A driving element, e.g., a linear motor, a crank gear, or the like, is arranged in the housing 51, with which the piercer C can be inserted into the fabric and retracted again at an acute angle to the axis $V_1$ of the needle 8. Typically, three needle stitches are performed per cut-in of the piercer C. This means that the piercer must cut into the fabric and be drawn out of the fabric again only for every second stitch of the needle 8. In the drive housing 51, in addition to the linear drive, there can also be a controller, which, connected to the sewing machine by means of a cable or a plug that is not visible in the figures, controls the movement of the piercer C. A somewhat larger recess 18 must be provided in the needle plate for a household sewing machine next to the piercer C, which is supported in the drive housing 51, so that the piercer C can pass through the needle plate 21 before the needle cuts into the fabric.

In FIG. 13, the piercer C has already passed through the needle plate 21 and the needle 8 has also passed vertically from above through the recess 27 in the piercer. FIG. 14 shows the piercer C and the needle 8 in the optimal retracted position, e.g., before the fabric has been pushed under the needle 8 and the piercer C or when the fabric has been advanced by the feed dog.

The invention claimed is:

1. Sewing machine comprising at least one needle (8) for creating a hemstitch in a fabric (1) and a feed dog (31) for advancing the fabric, wherein an axis ($V_1$) of the at least one needle (8) extends at an acute angle (alpha) to an axis (Y) of at least one piercer (C), the needle (8) is driven by a needle bar drive in a direction of the axis ($V_1$), and the piercer (C) is driven by a piercer drive in a direction of the axis (Y) of the piercer (C), the at least one piercer (C), viewed in a sewing direction (5), is arranged at a side of the needle (8) and comprises a slot (27) extending in the piercer (C) or at least one side groove (28) formed on a periphery of the piercer (C), through which the at least one needle (8) can pass laterally within a piercer cross section during stitch formation, and the at least one needle comprises two needles (8, 9) arranged axially symmetric to the piercer (C) lying in a V shape which cross in the slot (27) in the piercer (C) or in the at least one side groove (28) during the stitch formation within the piercer cross section.

2. Sewing machine according to claim 1, wherein in the piercer (C), the slot (27) comprises a slot formed for each of the two needles (8, 9) or the slot (27) is a common slot for both of the needles (8, 9) or the groove (28) comprises a groove formed for both of the needles (8, 9).

3. Sewing machine according to claim 1, wherein the needle axis ($V_1$, $V_2$) is supported so that the needle axis can pivot or shift with the at least one needle (8, 9) for changing a stitching position.

4. Sewing machine according to claim 1, wherein the angle (alpha) is equal to about 30° between the axis ($V_1$, $V_2$) of each respective one of the needles (8, 9) and the axis of the piercer (C).

5. Sewing machine comprising at least one needle (8) for creating a hemstitch in a fabric (1) and a feed dog (31) for advancing the fabric, wherein an axis ($V_1$) of the at least one needle (8) extends at an acute angle (alpha) to an axis (Y) of at least one piercer (C), the needle (8) is driven by a needle bar drive in a direction of the axis ($V_1$), and the piercer (C) is driven by a piercer drive in a direction of the axis (Y) of the piercer (C), wherein the feed dog (31) comprises two advancing belts (33), which can be driven to rotate in parallel and having upper belt sections that project over a needle plate (21) of the sewing machine, and/or there is at least one advancing wheel (34, 35), which can be driven and which interacts with a holder wheel on a presser bar during sewing and advances the fabric (1) in a clamped manner.

6. Sewing machine according to claim 5, wherein at least one of the advancing belts (33) or the one or more advancing wheels (34, 35) are free-running.

7. Sewing machine according to claim 1, wherein two hooks (24, 25) rotate or oscillate on rotational axes (28, 29) arranged parallel to the needle plate (21) and the rotational axes (28, 29) are parallel to a sewing direction (5).

8. Sewing machine comprising at least one needle (8) for creating a hemstitch in a fabric (1) and a feed dog (31) for advancing the fabric, wherein an axis ($V_1$) of the at least one needle (8) extends at an acute angle (alpha) to an axis (Y) of at least one piercer (C), the needle (8) is driven by a needle bar drive in a direction of the axis ($V_1$), and the piercer (C) is driven by a piercer drive in a direction of the axis (Y) of the piercer (C), wherein a drive element for the at least one piercer (C) is housed in a separate housing (51), which can be mounted on the sewing machine and which can be connected to a controller and power supply of the sewing machine, and the piercer axis (y) lies at an acute angle to a needle plate (21) of the sewing machine and can be driven in agreement with the needle drive.

* * * * *